United States Patent [19]

Hart

[11] 4,452,549

[45] Jun. 5, 1984

[54] TUNNEL LINING RINGS

[75] Inventor: Anthony J. R. Hart, Leicester, England

[73] Assignee: Charcon Tunnels Limited, Nottinghamshire, England

[21] Appl. No.: 356,744

[22] Filed: Mar. 10, 1982

[51] Int. Cl.[3] ..... E21D 11/10; E21D 11/15

[52] U.S. Cl. ..... 405/151; 405/150

[58] Field of Search ..... 405/146, 150, 151, 152, 405/153, 288

[56] References Cited

FOREIGN PATENT DOCUMENTS

| | | | |
|---|---|---|---|
| 480903 | 8/1929 | Fed. Rep. of Germany | 405/150 |
| 623703 | 5/1949 | United Kingdom . | |
| 839785 | 6/1960 | United Kingdom . | |
| 896096 | 5/1962 | United Kingdom . | |
| 944064 | 12/1963 | United Kingdom | 405/150 |
| 1507977 | 4/1978 | United Kingdom . | |
| 613112 | 6/1978 | U.S.S.R. | 405/151 |

*Primary Examiner*—David H. Corbin

*Attorney, Agent, or Firm*—Cushman, Darby & Cushman

[57] ABSTRACT

The disclosure relates to a tunnel lining ring made up of a plurality of pre-cast arcuate concrete tunnel lining segments (10,11). The segments providing the lower part of the ring are formed with a recess (17) around the inner surface thereof to receive a secondary lining (18) in the completed tunnel to enable the inner surface of the invert of the tunnel to be graded as required and hence eliminate irregularities caused during the construction of the tunnel.

2 Claims, 3 Drawing Figures

TUNNEL LINING RINGS

FIELD OF THE INVENTION

This invention relates to tunnel lining rings and to segments therefor.

DESCRIPTION OF THE PRIOR ART

U.K. Patent Specification No. 623,703 discloses a tunnel lining construction formed from precast concrete plates or slabs of a curvature corresponding to that of the tunnel. The plates or slabs being secured in position by means of rings formed of precast segments bolted together, said segments having channels of U-shaped cross-section on the opposite sides thereof into which fit the edges of the plates or slabs. The lining may itself be lined internally by means of bricks or by concrete to provide a smooth internal surface.

In order to avoid the complications which arise from the provisions of curved slabs and separate ribs for joining the slabs together followed by an internal lining of bricks or concrete, linings have been developed for tunnels in which arcuate segments of smooth internal surface are joined together edge-to-edge by arrangements which create a completely smooth internal surface to the lining without the need for a further lining of bricks or concrete. U.K. Patent Specification Ser. No. 165,394 (Horncy et al) equivalent to U.S. Pat. No. 2,004,931 illustrate such linings. A difficulty arises in the case where it is necessary to provide a lining having a bottom surface which is either completely level or follows accurately a required gradient since some settlement between the rings inevitably occurs as a result of the normal erection process.

It is therefore an objection of the present invention to provide a tunnel lining arrangement in which provision is made for compensating for any out of alignment between adjacent segments along the bottom of the tunnel lining to enable the bottom surface of the lining to be constructed to a required line or level.

SUMMARY OF THE INVENTION

This invention provides a tunnel lining ring comprising a plurality of pre-cast arcuate concrete tunnel lining segments, the inner surface of the ring having a recess in an arcuate section of a bottom part of the ring extending from end-to-end of the ring and a screed cast in the recess to provide the required level along the inner surface of the bottom of the tunnel lining.

By varying the thickness of the screen applied to the bottom of the lining in the recess, compensation can be made for the usual inaccuracies which occur in laying the lining to provide a true inner surface to the bottom of the lining.

A further object of the invention is to provide a lining in which the segments providing said arcuate sections of the ring are formed to provide stepped faces facing each other around the lower part of the ring defining the recess which receives the screed.

More specifically, the ring segments may be made up of a number of segments of standard thickness together with two further segments providing said arcuate sections of the ring each of which increases in thickness from one circumferential end around the segment ends formed with a step partway around the segment where the thickness returns to the standard thickness for the rest of the segment to provide the recess for the screed.

DESCRIPTION OF THE PREFERRED EMBODIMENT

Figure 1:
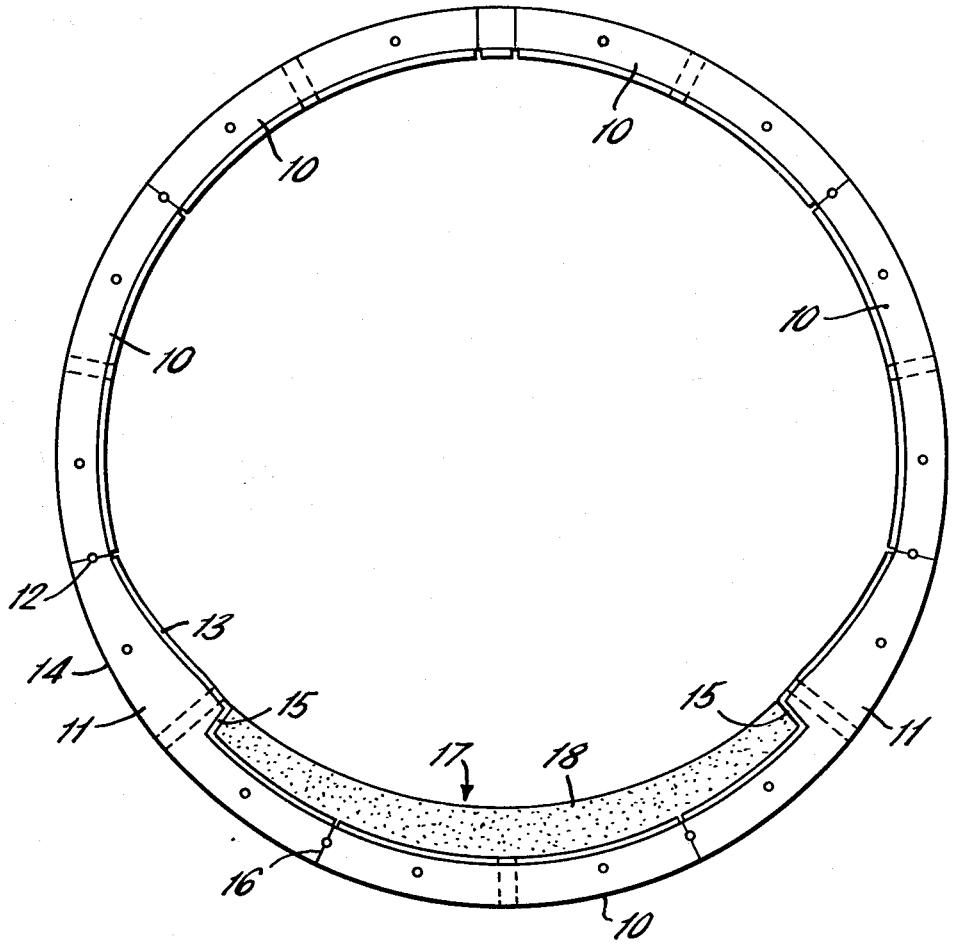
FIG. 1 is an end view of a tunnel lining ring having a screed along the bottom inner surface.

FIG. 1 of the drawing shows in elevation one ring of tunnel lining segment forming part of a tunnel lining and comprising a number of standard thickness pre-cast concrete segments 10 generally similar to the segments described and illustrated in our U.K. Patent Specification No. 2,004,931. The joint construction described in that application for the longitudinal and circumferential faces are also used for the segments of the present invention to provide a tunnel lining having a smooth internal surface without the need of a secondary internal lining as can be seen in the drawing.

A standard segment 10 is laid at the inverse of the ring and stepped surface segments 11 are laid on either side of the inverse segment. Each stepped surface segment 11 is of standard thickness at one end 12 and the inner surface 13 of the segment diverges from the outer surface 14 to form an increase in the thickness towards the centre of the segment. Adjacent the centre of the segment a step 15 is formed on the inner surface facing towards the other end 16 of the segment. At the step 15 the segment reduces in thickness to the standard thickness, that thickness being maintained over the part of the segment between the step 15 and said other end 16. A recess 17 is thus formed around the invert of the lining between the step 15 and after erection of the tunnel lining to receive a concrete screed 18 cast in the recess flush with the inner surfaces 13 of segments 11 to provide the bottom inner surface of the tunnel.

Figure 2:
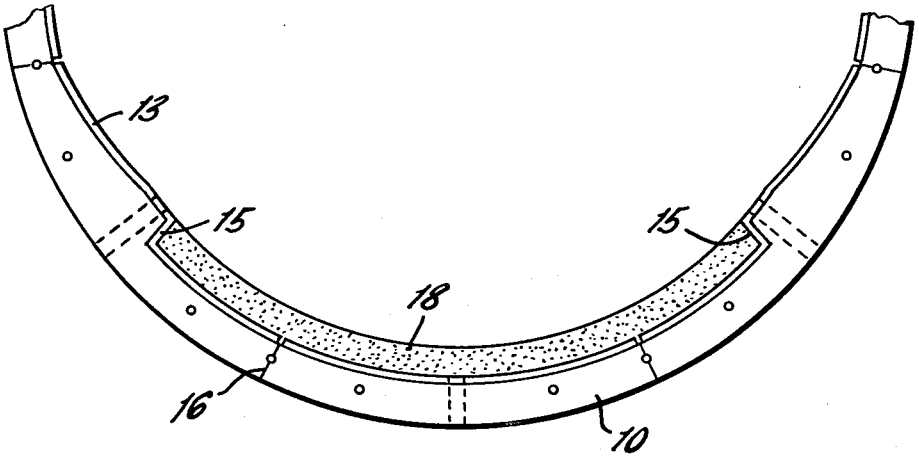
FIGS. 2 and 3 illustrate the lower parts of the lining and showing the different screen thicknesses to cater for slight irregularities in the laying of the tunnel lining segments.
Figure 3:
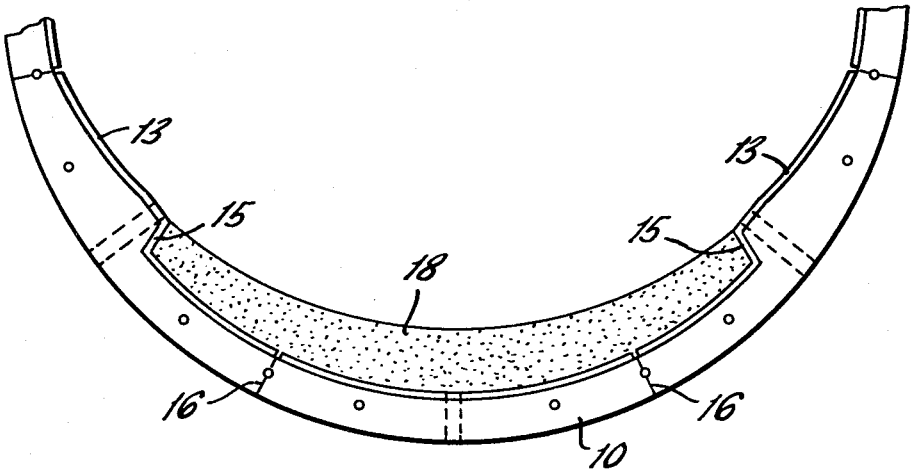

Normally a tunnel cannot be driven to an accurate grade and, at best, it is only possible to achieve an accuracy of plus or minus 20 mm. By varying the thickness of the screed as cast in the centre of the recess, the out of level of the tunnel lining can be compensated for and an invert surface is formed in the tunnel lining to the required design level. In the embodiment illustrated, by way of example, the depth of the steps 15 is 100 mm and the screen thickness at the centre of the recess can be varied from a thickness of 150 mm for a lining built to a true level as illustrated in FIG. 1 to a minimum of 100 mm as illustrated in FIG. 2 and to a maximum of 200 mm as illustrated in FIG. 3. Thus the screed can be varied in thickness to provide a compensation of up to ±50 mm variation in the tunnel lining from the true level.

I claim:

1. A tunnel lining ring comprising a plurality of precast arcuate concrete tunnel lining segments connected together to form a ring of circular outer form, the ring comprising a number of arcuate segments of uniform radial thickness and two further arcuate segments disposed in a lower part of the ring, each further segment having a portion extending from one end thereof having a curved inner surface which diverges from the outer surface away from the said end of the segment increasing the radial thickness of the segment to a step extending across the segment in an axial direction and facing toward the other end of the segment, the part of the segment between the step and said other end of the segment being of uniform radial thickness, said further segments being disposed in the ring of segments with the steps facing each other around the lower part of the ring to provide a recess in the lower part of the ring between the steps and a screed cast in the recess with a curved inner surface to merge with said curved inner surfaces of the further segments to provide the required level along the inner surface of the bottom of the tunnel lining ring.

2. A tunnel lining ring as claimed in claim 1 wherein a segment of uniform radial thickness is disposed between said two further segments at the bottom of the ring and said screed is cast over the inner surface of said uniform thickness segment.

* * * * *